United States Patent [19]

Baier et al.

[11] 4,185,907

[45] Jan. 29, 1980

[54] SUPPORT ASSEMBLY FOR COMPONENTS OF ELECTROSTATIC COPIERS

[75] Inventors: Erich Baier, Sunzhausen; Hans Hahn, Unterhaching, both of Fed. Rep. of Germany

[73] Assignee: Siemens Aktiengesellschaft, Berlin & Munich, Fed. Rep. of Germany

[21] Appl. No.: 842,609

[22] Filed: Oct. 17, 1977

[30] Foreign Application Priority Data

Apr. 19, 1977 [DE] Fed. Rep. of Germany ..... 2717269

[51] Int. Cl.[2] ..... G03G 15/00

[52] U.S. Cl. ..... 355/3 R; 355/3 DD

[58] Field of Search ..... 355/3 R, 3 DD, 3 DR, 355/3 FU, 14, 15

[56] References Cited

U.S. PATENT DOCUMENTS

| | | | |
|---|---|---|---|
| 3,099,856 | 8/1963 | Eichorn et al. | 15/256.51 |
| 3,099,943 | 8/1963 | Eichorn et al. | 355/8 |
| 3,384,012 | 5/1968 | Zernov | 101/216 |
| 3,689,146 | 9/1972 | Ito et al. | 355/3 DR |
| 3,721,209 | 3/1973 | Szostak et al. | 118/2 |
| 3,883,242 | 5/1975 | Takahashi et al. | 355/3 DR |
| 3,924,944 | 12/1975 | Smith et al. | 355/3 DD |
| 3,957,368 | 5/1976 | Goshima et al. | 355/8 |
| 3,985,436 | 10/1976 | Tanaka et al. | 355/3 DD |

*Primary Examiner*—R. L. Moses

*Attorney, Agent, or Firm*—Hill, Van Santen, Steadman, Chiara & Simpson

[57] ABSTRACT

A support assembly for the components of one or more operating units associated with an intermediate carrier of an electrostatic copier. The components are arranged in a carriage member which is slide supported on frame members of the copier to be movable axially of the intermediate carrier drum. The components within a carriage are supported for movement towards and away from the drum surface.

7 Claims, 3 Drawing Figures

SUPPORT ASSEMBLY FOR COMPONENTS OF ELECTROSTATIC COPIERS

BACKGROUND OF THE INVENTION

1. Field of the Invention

This invention relates to electrostatic copiers and more particularly to support assemblies for components thereof.

1. Prior Art

This invention is directed to that class of device generally known as a nonmechanical printer or copier in which operating units for generating charge patterns on an intermediate carrier, for developing the charge patterns with toner, and for transferring the toner images onto a recording carrier are positioned alongside the intermediate carrier. Such devices are herein collectively described as electrostatic copiers however it is to be understood that that term is used in an inclusive capacity. In such devices both the operating units and the intermediate carrier must be readily accessible without damage to either the unit or the carrier.

The production of images on a recording carrier such as, for example, a sheet of paper by electrostatic techniques in copiers or nonmechanical printers is well known. See for example U.S. Pat. No. 3,099,856. In such devices charge images or latent images of the symbols to be printed on the recording carrier are generated either electrographically or electrophotographically on an intermediate carrier which may, for example, be a drum with a dielectric or photoelectric coated surface. The latent images are developed at a developing station positioned along the circumference of the drum. Development is done with the aid of a toner to produce toner images on the intermediate carrier which images are thereafter printed onto the recording carrier at a transfer station positioned further along the circumference of the drum. At the transfer station the toner images are transferred from the drum surface to the recording carrier. The transferred images can later be fused onto the recording carrier at a fixing station. Further along the drum circumference from the transfer station may be positioned a drum cleaning unit for cleaning the drum surface of any toner residue. Also positioned along the drum circumference are means for applying a charge to the drum surface.

Thus a plurality of operating units are arranged adjacent the intermediate carrier. Such units either produce the toner image, i.e. the developing station and the transfer station or may exist for producing the latent image such as electric combs or light sources or for charging the surface such as a corotron.

Each of these units, for example the developing station unit, must be positioned very precisely in relation to the intermediate carrier. However for purposes of servicing the unit, either for eliminating faults or for replacement or cleaning of parts, both the intermediate carrier and the components of the unit must be easily and readily accessible. It is therefore desirable to separate the units and intermediate carrier quickly, precisely and without problem and to reposition them in the desired operating position quickly. However since both the components of the operating units and the surface of the intermediate carrier are sensitive, the means by which the units are to be separated must be such as to insure that they will not contact each other during separation.

SUMMARY OF THE INVENTION

It is therefore a primary object of this invention to provide an arrangement in which such an operating unit, for example the developing station, and the intermediate carrier are each readily accessible without damage to one another.

This primary object is achieved by locating the components of the operating unit in a carriage. The carriage is suspended in slide guides which are mounted to the copier frame. The slide guides are positioned such that the carriage can be moved axially of the intermediate carrier. The components are mounted in the carriage in such a way that they can be moved inwardly and outwardly towards and away from the intermediate carrier surface.

For inward and outward movement towards and away from the intermediate carrier surface, it is preferred to mount the components within the carriage on eccentric rollers. By rotating the rollers on their eccentric mount the components of the operating unit can then be raised or lowered within the carriage. Ideally the rollers can be linked together through a connecting rod and can be moved by the aid of a lever arm.

In order to provide for accurate initial adjustment of the operating unit in relation to the intermediate carrier, a vertical adjustng device is provided between a mounting for at least one of the slide guides and a frame cross member. The adjustment device can consist of, for example, an adjusting screw.

Further, it has been found desirable to locate a guide pin on the frame cross member, the guide pin engaging the unit or the carriage when the carriage is properly pushed into the machine.

Additionally, a switch indicating the position of the unit can be provided which will generate a signal when the operating unit is not properly positioned with respect to the intermediate carrier.

It is therefore an object of this invention to provide a suspension system for operating units of electrostatic copiers where the components of at least one operating unit are commonly mounted in a carriage movable within the carriage towards and away from the intermediate carrier, the carriage being movable in a different plane with respect to the intermediate carrier.

It is another, and specific object of this invention to provide a support system for operating units of electrostatic copiers, the support system including a carriage member carried by slide means which are mounted on frame means of the copier, the slide means allowing the carriage to move inwardly and outwardly axially of a drum intermediate carrier adjacent thereto, the components of an operating unit being mounted within the carriage, the mounting of the components allowing components to be moved towards and away from the drum surface.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

In the following description, detail of an electrostatic copier is omitted as such detail is readily apparent from reference to the art, for example the aforementioned U.S. Pat. No. 3,099,856. Further the mounting device of this invention is shown only in association with one of the operating units of the intermediate carrier drum area of the copier, the unit being selected consisting of the development unit which is that assembly which applies toner to the drum surface. It is to be understood that other operating units can be mounted in the same fashion.

Figure 1:
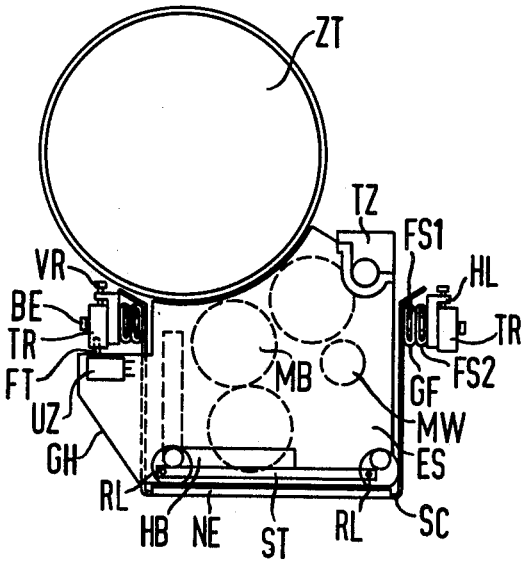
FIG. 1 is an end plan schematic view of portions of the intermediate carrier of an electrostatic copier and the carriage and operating unit mounting of this invention.

As shown in FIG. 1, a developing station ES of an electrostatic copier can be considered as one operating unit. Other units are positioned around the intermediate carrier ZT but are not illustrated in the Figure.

In general, the developing station ES is such as to convey a toner mixture to the surface of the intermediate carrier ZT from a storage container. Magnetic brushes MB may be used for this conveying. Such magnetic brushes are shown for example in U.S. Pat. No. 3,455,276. The developing unit ES also includes a mixing shaft MW and a toner feed TZ. The design and function of each of the elements of the developing unit are known from literature relating to electrostatic copiers and since they form no part of this invention, they are not hereinafter further described. The various components of the operating unit ES can be connected together through means such as end walls 6H, one of which is illustrated in the plan view of FIG. 1 with the components MB and MW positioned therebehind indicated by broken lines. In this manner all of the components of the operating unit can be collectively considered together as the operating unit ES.

The unit ES is positioned in a carriage SC. The carriage SC is essentially a member which is U shaped in cross section forming a trough for receipt of the unit ES. On the longitudinal sides of the carriage SC a first component FS1 of a guide rail assembly is affixed. A second component FS2 of a guide rail assembly is affixed to a mounting member HL and together the two components form a single slide guide GF. By means of the slide guides GF on each longitudinal side of the carriage SC, the carriage SC can be moved in the axial direction of the intermediate carrier ZT when the mountings HL are retained within the frame of the copier as hereinafter described.

The operating unit ES is supported on rollers RL within the carriage SC. The rollers RL are eccentrically mounted on the operating unit ES, for example to the end walls GH, and may, for example, run on rail means NE which is affixed to the base of the carriage SC. Rail means NE can be disposed at each transverse side of the carriage and rollers may be disposed at each axial end or transverse side of the operating unit ES.

It is therefore apparent that by rotation of the rollers RL about their eccentric mount, the unit ES can be raised or lowered with respect to the carriage base. Consequently the operating unit ES and the components thereof can be moved towards and away from the peripheral surface of the intermediate carriers ZT. In order to facilitate such movement the rollers RL can all be linked together by means of connecting rods ST. Additionally a lever arm HB can be attached to one of the rollers RL through which that roller and consequently all of the rollers can be rotated.

In order to adjust the position of the unit ES exactly in relation to the intermediate carrier, a vertical adjustment means VR is provided. The vertical adjustment means VR exists between at least one of the mountings HL of the slide guide and a frame cross member TR formed as a part of the frame of the copier. Preferably as shown, vertical adjustments VR are provided on each of the longitudinal sides of the carriage. As illustrated in FIG. 1, the vertical adjustment VL can comprise a screw member which is threaded through the wall of a ledge portion of the mounting HL which overlies a frame cross member TR. The screw bottoms on the frame cross member or in a bore therein and by adjustment of the degree of projection of the screw from the mounting HL, the position of the mounting HL with respect to the frame member TR can be adjusted. Thus by use of the adjusting screw the position of the carriage SC within the frame and therefore the operating unit ES with respect to the intermediate drum ZT can be adjusted towards and away from the drum surface. Once adjusted, the position can be set by a lock screw BE.

In order to properly position the carriage axially of the intermediate carrier drum ZT, a pin FT can be attached to the frame cross member TR and can abut an extension GH, for example a projection of the end wall, of the housing of the operating unit ES. The guide pin FT helps to determine when the carriage SC has reached its correct position upon being pushed into the copier or printer. Further correct positioning of the operating unit ES and the carriage SC can be checked by means of a switch UZ which may, for example, be mounted to the projection GH and be activated by the pin FT. The switch is therefore activated each time the carriage SC is moved away from the proper position and may emit a signal which may interrupt the operation of the copier.

Figure 2:
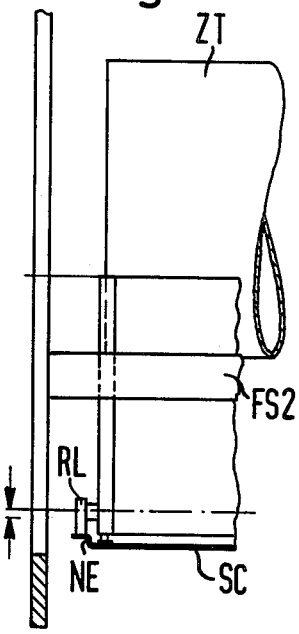
FIG. 2 is a side plan schematic view partially in section of the unit of FIG. 1.
Figure 3:
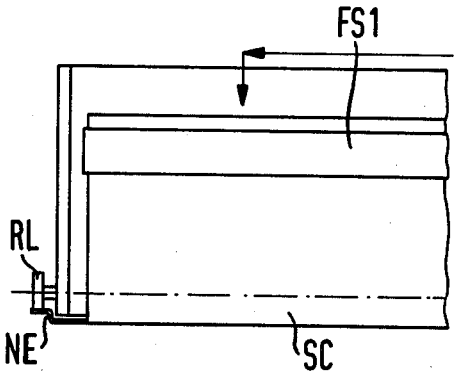
FIG. 3 is a side plan view of the unit and carriage as withdrawn from the vicinity of the intermediate carrier.

Functioning of the carriage and operating unit mounting of FIG. 1 is illustrated in FIGS. 2 and 3. FIG. 2 illustrates the position when the carriage SC is pushed into the copier and the unit ES is in its correct operating position. FIG. 3 illustrates the carriage SC and operating unit ES respectively withdrawn from the machine and moved away from the intermediate carrier surface.

As shown in FIG. 2, the operating unit ES and the carriage Sc are in correct working position when the unit ES is positioned very close to the surface of the intermediate carrier ZT and the carriage is pushed into the machine. The rollers RL are positioned so that the unit ES has been moved upwardly from the base of the carriage SC closely adjacent the intermediate carrier ZT. Upon counterrotation of the rollers RL to the position shown in FIG. 3, the operating unit ES will drop by the eccentric distance as indicated by the opposed arrows between the figures.

When carriage FC is moved out for maintenance purposes, for example, or to gain access to both the intermediate carrier ZT and the unit ES, the rollers RL are first rotated with the aid of the lever arm HB. This rotates the rollers from the position shown in FIG. 2 to the position shown in FIG. 3 and the unit ES is lowered within the carriage SC. The lowering withdraws the operating unit ES from any possible contact with the surface of the drum ZT which is highly sensitive. After dropping the operating unit ES through the rollers RL, the carriage SC can be moved out of the machine on the slide guides GF without any possible damage to the intermediate carrier by the unit ES. Upon completion of maintenance, the carriage SC can be pushed back into the copier up to the point where the guide pin ST engages. When engaged, it is known that the carriage SC is correctly positioned in the machine. By then returning the lever arm HB to its initial position, and thus rerotating the rollers RL, the unit ES will again be moved up adjacent the surface of the intermediate carrier and brought into its working position.

A primary advantage of the arrangement of this invention is the fact that the intermediate carrier ZT and the operating units ES are accessible for maintenance purposes easily and without likelihood of damage during the partial disassembly necessary for access.

Although the teachings of our invention have herein been discussed with reference to specific theories and embodiments, it is to be understood that these are by way of illustration only and that others may wish to utilize our invention in different designs or applications.

We claim as our invention:

1. A mounting for operating units having an operating position adjacent an intermediate carrier in an electrostatic copier comprising: a carriage member, an operating unit received in the carriage member, the carriage member being suspended on a frame means of the copier, the suspension including slide guides allowing the carriage to be slid with respect to the frame of the copier axially of the intermediate carrier, the operating unit being adjustably mounted within the carriage, the adjustable mounting allowing the operating unit to be moved towards and away from a surface of the intermediate carrier, the carriage is equipped with rail means on which roller members ride, the roller members eccentrically mounted to the operating unit, rotation of the roller members with respect to the operating unit moving the operating unit with respect to the carriage, the operating unit has transverse ends adjacent axial ends of the intermediate carrier, each transverse end being provided with two such rollers, and the rollers on each end being linked together for simultaneous rotation.

2. The device according to claim 1 wherein the carriage has longitudinally extending side walls which extend axially of the intermediate carrier, a slide guide being attached to each of the longitudinal sides.

3. The device according to claim 2 wherein the slide guides are attached to frame cross members, the attachment of the slide guide to the frame cross member allowing adjustment of the position of the slide guide with respect to the frame cross member.

4. A device according to claim 3 wherein a stop pin is positioned on the frame cross member effective to engage one of the carriage and operating unit when the carriage has been properly withdrawn into the copier adjacent the intermediate carrier.

5. A device according to claim 4 including a switch means activated whenever the carriage is withdrawn from an operating position, the switch means effective to signal carriage withdrawal.

6. In an electrostatic copying device having a frame with an intermediate carrier drum supported therein, the intermediate carrier having a plurality of operating units disposed adjacent thereto effective to act upon an operating surface of the intermediate carrier each of the units including at least one active component, the improvement of the component of at least one unit mounted in a carriage, slide means mounting the carriage to the frame, said slide means effective to allow the carriage and component therein to move in one place towards and away from the intermediate carrier, variable support means interposed between the carriage and component allowing the component to move in a second plane different from the one plane towards and away from the surface, the intermediate carrier is a drum means with the surface at its circumference, the slide means allowing the carriage to move axially of the drum, and the support means allowing the components to move substantially radially of the drum, the support means is interposed between the components and the carriage, the support means includes common sub-frame members to which the components are attached, the sub-frame members being equipped with eccentric rollers the roller riding against surfaces of the carriage.

7. An electrostatic copier comprising a frame, an intermediate carrier drum disposed in said frame, a plurality of operating units disposed in said frame adjacent said intermediate carrier, at least one of said operating units including components support wall means, carriage slidably attached to said frame movable axially of said drum on the slidable mounts, the one operating unit positioned within said carriage, and adjustable support means between the carriage and the one operating unit allowing selective movement of the one operating unit towards and away from a surface of the carriage whereby the one operating unit can be moved towards and away from the drum surface in a plane substantially normal to the slide movement of the carriage, the adjustable support means comprise eccentric mounted rollers attached to the support wall means, the rollers rotatable on the eccentric mounts, the rollers riding on a carriage surface whereby the degree of rotation of the rollers on the eccentric mounts determines the space between the support wall means and the surface of the carriage.

* * * * *